US006527341B1

(12) United States Patent
Martin

(10) Patent No.: US 6,527,341 B1
(45) Date of Patent: Mar. 4, 2003

(54) HINGE ASSEMBLY FOR FOLDING SEAT

(75) Inventor: Craig A. Martin, LeRoy, MI (US)

(73) Assignee: Genmar IP LLC, Minneapolis, MN (US)

( * ) Notice: Subject to any disclaimer, the term of this patent is extended or adjusted under 35 U.S.C. 154(b) by 156 days.

(21) Appl. No.: 09/595,706

(22) Filed: Jun. 16, 2000

(51) Int. Cl.[7] ..... A47C 1/12

(52) U.S. Cl. ..... 297/332; 297/334; 297/336; 297/14; 248/240.4

(58) Field of Search ..... 297/13, 14, 331, 297/332, 334, 335, 336; 248/240.4

(56) References Cited

U.S. PATENT DOCUMENTS 1,428,018 A * 9/1922 Erickson ..... 297/332 X
1,685,137 A * 9/1928 Nichols ..... 248/240.4 X
4,639,037 A * 1/1987 Maruyama et al. ..... 297/334
5,584,530 A * 12/1996 Rogers et al. ..... 297/334
5,974,397 A * 11/1997 Dawson et al. ..... 297/14
6,293,603 B1 * 9/2001 Waku et al. ..... 297/334

* cited by examiner

*Primary Examiner*—Anthony D. Barfield
(74) *Attorney, Agent, or Firm*—Merchant & Gould P.C.

(57) ABSTRACT

A seat is pivotally mounted to a wall by means of at least one hinge assembly, enabling the seat to be folded. The hinge assembly provides an upward and rearward movement as the seat pivots from a horizontal to a vertical orientation during folding. The hinge assembly has a seat mounting bracket mounted to the lower surface of the seat and a wall mounting bracket mounted to the wall. The seat mounting bracket is connected to the wall mounting bracket via a pair of pivoting arms. Each pivoting arm is pivotally connected at one end to the wall mounting bracket and at an opposite end to the seat mounting bracket. The pivot locations are selected such that as the arms pivot in a clockwise direction, the seat mounting bracket pivots in a counterclockwise direction. The pivoting arms can pivot only in a vertical direction, and serve to guide the seat upward from a lower position to a relatively higher position, the seat at the same time being pivoted from a horizontal position to a vertical position, and vice versa.

3 Claims, 6 Drawing Sheets

HINGE ASSEMBLY FOR FOLDING SEAT

FIELD OF THE INVENTION

This invention generally relates to folding seats for one or more persons. In particular, the invention relates to folding seats adapted for use on boats.

BACKGROUND OF THE INVENTION

Marine craft are exposed to a wide variety of harsh environmental conditions, and the limited available space necessitates an efficient deck layout. It is common for many boat components to be removable or adjustable to provide more deck space or to facilitate cleaning, storage and protection from the elements. A standard seat assembly for marine use generally consists of a horizontal seat with a padded upper surface, affixed at the rear edge to a bulkhead, transom or other vertical wall surface, generally with support stanchions supporting the front edge of the seat on the deck of the boat. The seat can usually be removed if desired, or the rear edge of the seat may be affixed to the wall by one or more hinges. To move the seat away from a horizontal position, the support stanchions, if any, are removed and the seat is pivoted downward so that the seating portion, or top, of the seat is vertical and faces the interior of the cockpit.

This type of hinged seat, however, can have problems because the depth, back to front, of many such seats is nearly equal to the height of the seat above the deck. As these seats pivot from a horizontal to a vertical position, the front edge of the seat arcs down and rearward, to a position close to the deck. This is undesirable because the seat will then be subject to various hazards which may be on the deck of the boat, for example, water, fishing tackle, scuba gear and the like. The seat is also much more likely to be inadvertently struck by a passenger's feet, creating a tripping hazard in addition to subjecting the seat to possible damage. Furthermore, it can be difficult to remove seats which are hinged in this manner.

Accordingly, it would be desirable to provide a folding seat assembly which can pivot from a horizontal to a vertical position while at the same time being displaced upward, away from the deck, and rearward, toward the wall, so that the cushioned portion of the seat, when vertical, faces the interior of the boat rather than the wall to which it is mounted. It is further desirable to provide a seat assembly which can be readily removed for storage or cleaning.

SUMMARY OF THE INVENTION

The present invention is directed to a seat which is pivotally mounted to a stationary surface, e.g., a wall, by means of at least one hinge assembly, thereby enabling the seat to be folded. The hinge assembly provides an upward and rearward movement as the seat pivots from a horizontal to a vertical orientation during folding. The hinge assembly has a seat mounting bracket mounted to the lower surface of the seat and a wall mounting bracket mounted to the wall. The seat mounting bracket is connected to the wall mounting bracket via a pair of pivoting arms. Each pivoting arm is pivotally connected at one end to the wall mounting bracket and at an opposite end to the seat mounting bracket. The pivot locations are selected such that as the arms pivot in a clockwise direction, the seat mounting bracket pivots in a counterclockwise direction. The pivoting arms can pivot only in a vertical direction, and serve to guide the seat upward from a lower position to a relatively higher position, the seat at the same time being pivoted from a horizontal position to a vertical position, and vice versa.

With a higher position on the wall, the seat can be safely used by passengers leaning against the top surface of the seat rather than against the wall. This also lessens the risk of passengers tripping on or kicking the seat. The boat can additionally accommodate more passengers within the available deck space, while providing comfort via the padding of the vertical seat surface.

In addition, the seat can be slid off of the hinge assemblies by the simple expedient of lifting the seat straight upward when the seat is in the upright, i.e., folded position. The seat is coupled to the hinge assemblies by mating elements which slidably couple to each other, one element receiving a portion of the other element in an opening which is closed at one end to stop downward movement of the seat when the seat is slid back on.

The hinge assembly disclosed herein can be employed singly or in groups. For example, one hinge assembly could be used to support a single seat, while two or more hinge assemblies can be used to support a seat or bench designed to hold more than one person. Although the preferred embodiment is disclosed in connection with a seat mounted to a wall of a boat, the person skilled in the art will recognize that employment of hinge assemblies constructed in accordance with the preferred embodiment is not limited to seats on boats or seats mounted to walls. For example, these hinge assemblies could also be used to support folding seats on trains or folding seats which are mounted on a post instead of on a wall.

DESCRIPTION OF THE DRAWINGS

FIG. 2 also shows the orientation of a removed seat prior to attachment of the seat to the hinge mechanisms.

DETAILED DESCRIPTION OF THE PREFERRED EMBODIMENTS

Figure 1:
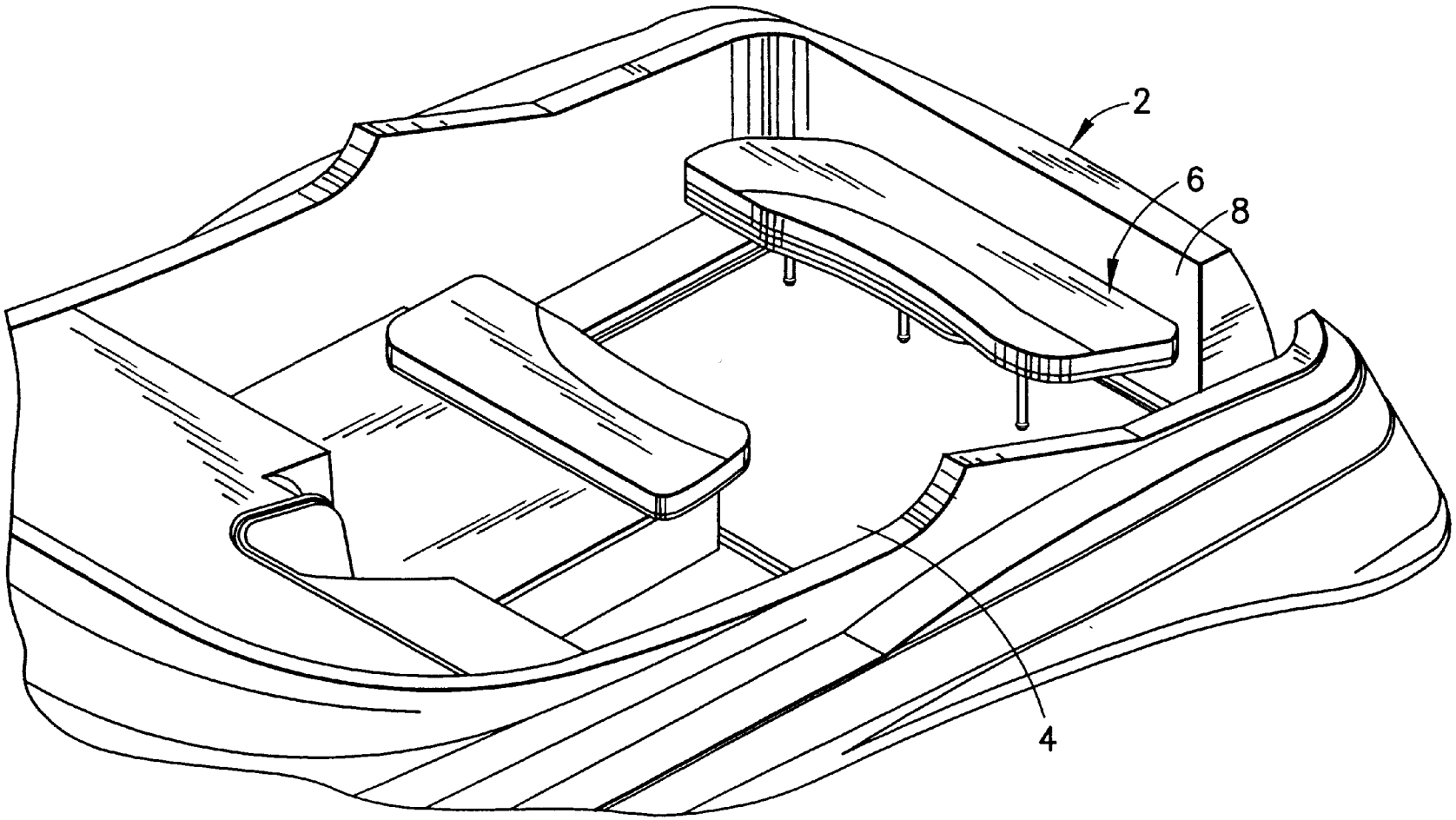
FIG. 1 is a perspective view of the aft portion of a boat with the hinged seat assembly in accordance with a preferred embodiment of the present invention in the horizontal position.
Figure 2:
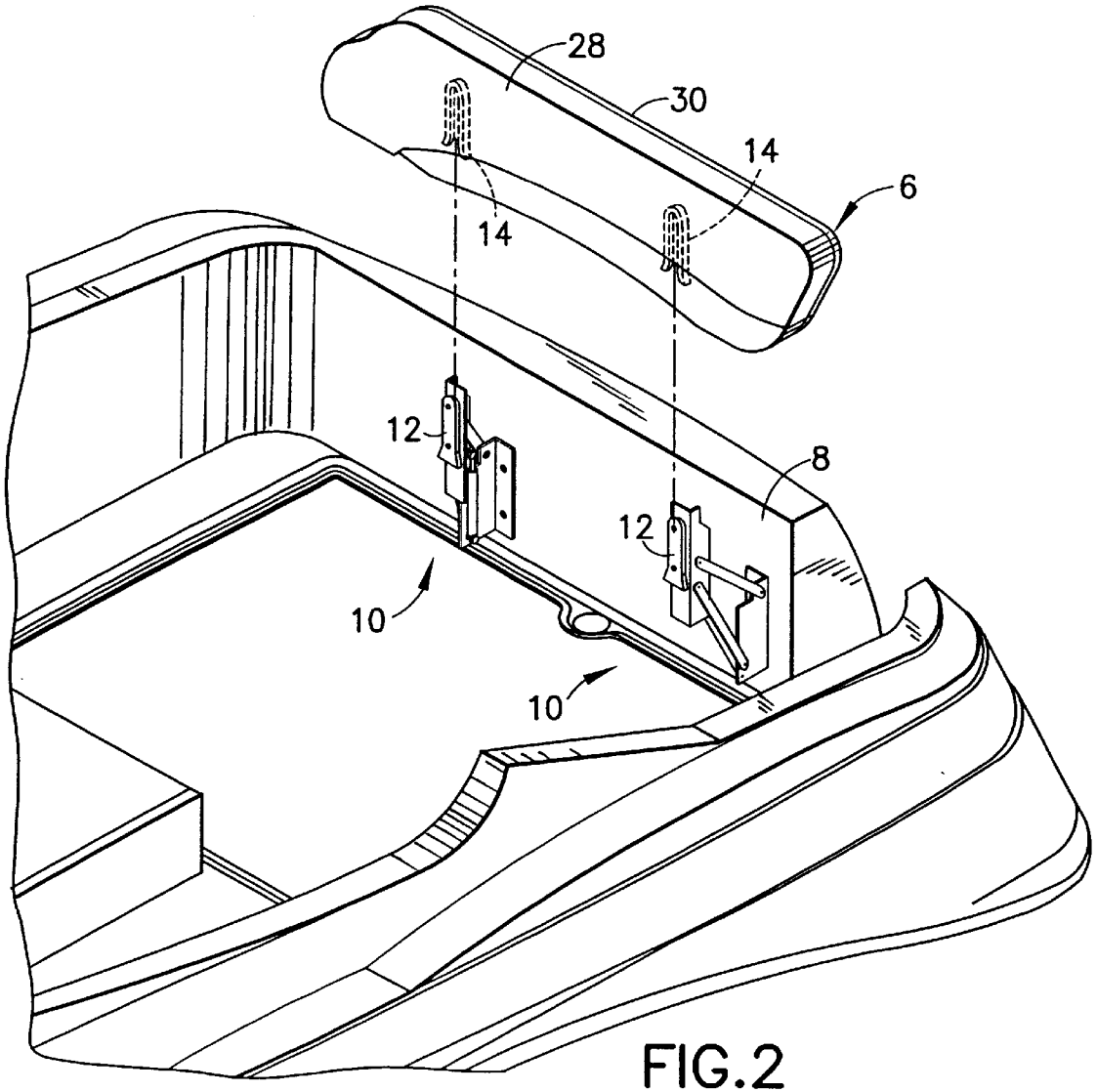
FIG. 2 is a perspective view of the aft portion of a boat having a pair of hinge mechanisms in accordance with the preferred embodiment of the invention, mounted to the transom wall and moved to respective up positions.

Referring to FIG. 1, a boat 2 is shown having an aft deck region 4, including a seat 6 abutting the stern wall or transom 8. As illustrated in FIG. 2, the seat 6 is mounted to the transom 8 by means of a plurality of hinge assemblies 10. The hinge assemblies 10 allow the seat 6 to be manipulated between a horizontal seat position generally parallel to the deck 4 and a vertical position generally parallel to the transom 8. FIG. 2 shows the hinge assemblies 10 in generally upright positions with the seat removed.

In accordance with the preferred embodiment of the invention, the seat 6 is removably attached to the hinge assemblies 10 by at least two pairs of mating members, each pair consisting of a male mating member 12 which is affixed to the hinge mechanism 10 and a U-shaped female or receiving mating member 14 (indicated by dashed lines in FIG. 2) attached to the bottom surface of the seat 6. The seat 6 can be securely attached to the hinge assemblies 10 by respectively coupling the mating members 14 with the corresponding mating members 12. Preferably mating member 14 slides snugly onto mating member 12, mating member 12 having respective longitudinal projections on its lateral surfaces which slide into and mate with form-fitting longitudinal grooves formed on opposing sides of a central opening in mating member 14. The central opening of mating member 14 is closed at one end to stop further travel of the inserted mating member 12. Obviously, the positions of mating members 12 and 14 can be reversed so that the male mating member 12 is attached to the seat bottom and the female mating member 14 is attached to the hinge mechanism. In the case of a seat designed for a single person, a single pair of mating members could be used to couple the seat to a single hinge mechanism. The mating members are preferably made of a durable plastic material, such as polypropylene or polyvinyl chloride.

In a conventional hinged seat, the rear edge of the seat is immovably hinged to a wall so that the front edge of the seat describes an arc of 90° downward and rearward, as the rear edge of the seat pivots but remains otherwise stationary. If instead the seat is hinged so that it pivots upward to a vertical position, the top of the seat will face the bulkhead. In accordance with the preferred embodiment of the present invention, the hinge mechanisms guide the seat to pivot upward to a vertical position such that the cushioned top of the seat 6 faces the interior of the boat rather than the wall to which it is mounted, with the rear edge of the seat being higher than the front edge of the seat.

Figure 3:
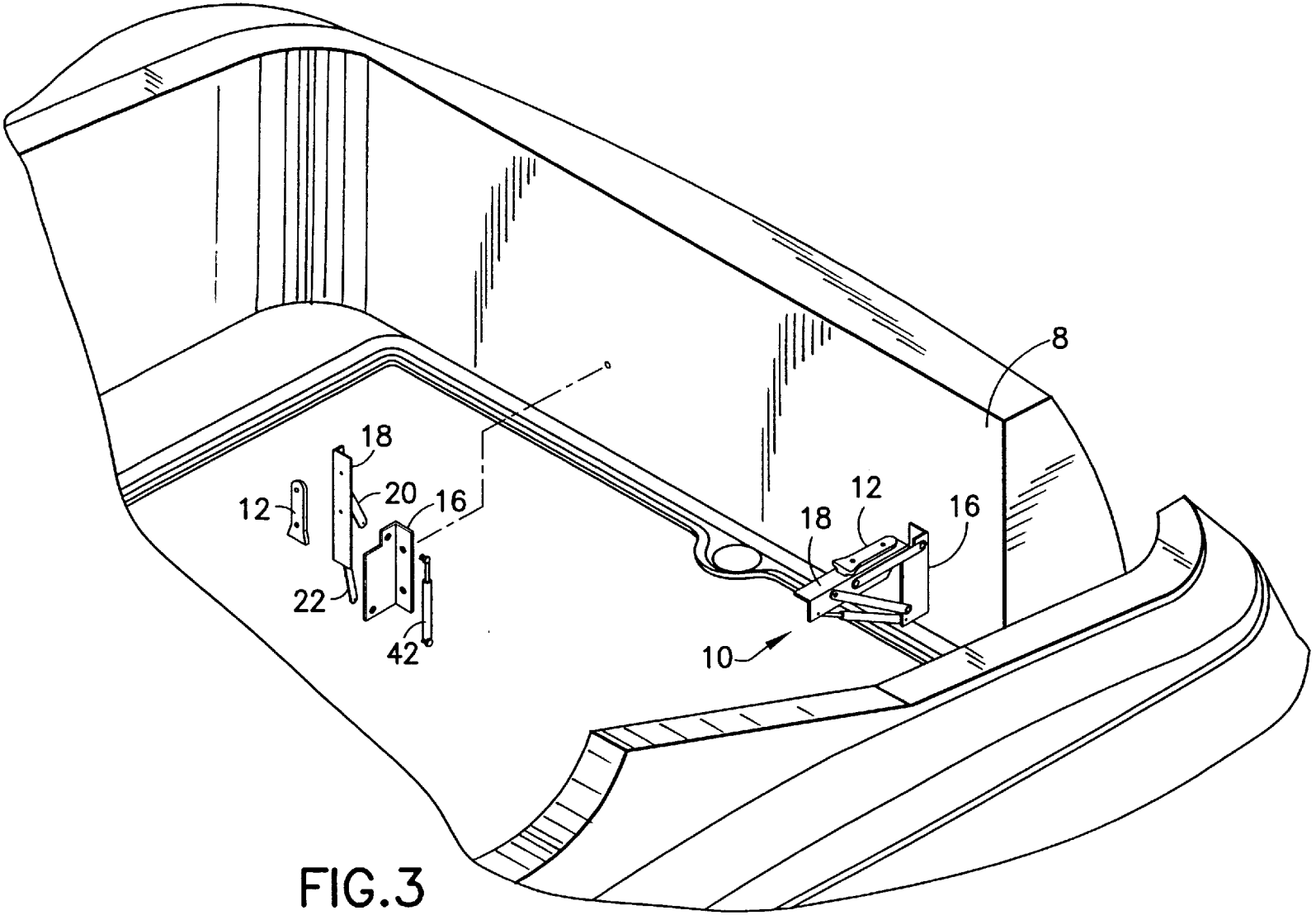
FIG. 3 is a perspective view of the aft portion of the same boat with one hinge mechanism depicted in the horizontal position and another hinge mechanism shown in an exploded state.

FIG. 3 illustrates further details of the hinge assembly in accordance with the preferred embodiment. The hinge assembly has a seat mounting bracket 18 mounted to the lower surface of the seat (not shown in FIG. 3) and a wall mounting bracket 16 mounted to the transom 8. The seat mounting bracket 18 is connected to the wall mounting bracket 16 via a pair of pivoting arms 20 and 22. Each pivoting arm is pivotally connected at one end to the wall mounting bracket 16 and at an opposite end to the seat mounting bracket 18. With regard to the composition of the hinge mechanisms, it can be appreciated that for marine use, a durable, corrosion-resistant, high-strength rigid material is required, for example, aluminum, stainless steel and the like.

In accordance with the preferred embodiment, the pivot locations are selected such that as arms 20 and 22 pivot in a clockwise direction, the seat mounting bracket 18, with the seat attached thereto, pivots in a counterclockwise direction. The axes of the pivot points are substantially horizontal so that each pivoting arm 20, 22 can pivot in a vertical direction only, allowing the seat 6 to move from a generally vertical orientation (shown in FIG. 2) to a generally horizontal orientation (shown in FIG. 1) and vice versa.

Figure 5:
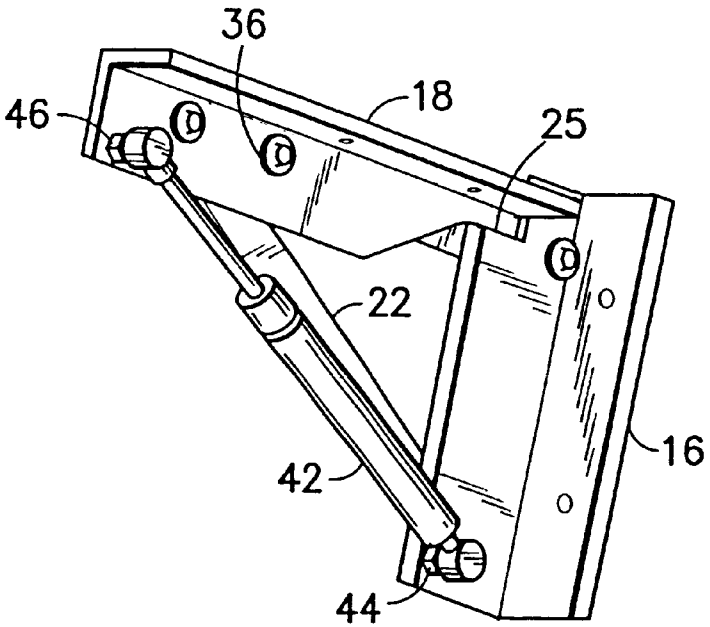
FIG. 5 is a perspective view taken from the opposite the hinge assembly shown in FIG. 4.
Figure 4:
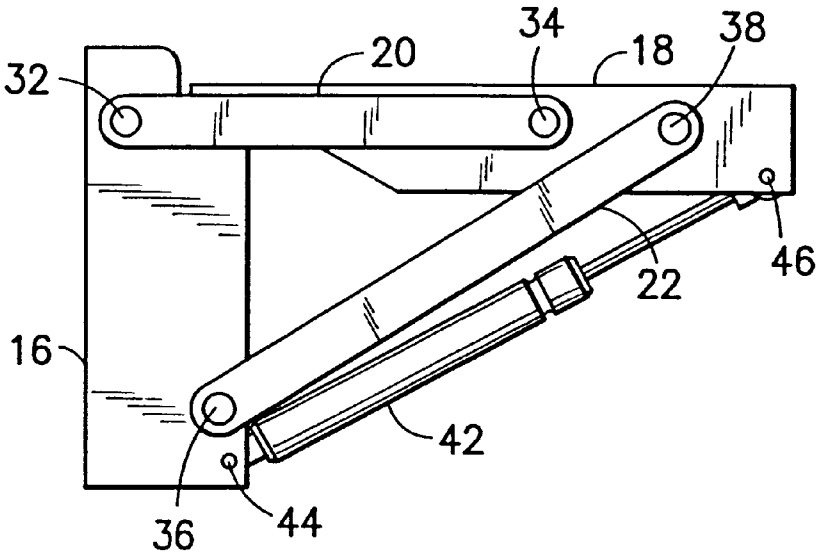
FIG. 4 is an elevation view of a hinge assembly in accordance with the preferred embodiment of the invention, shown with the seat mounting bracket in the down, i.e., horizontal, position.
Figure 7:
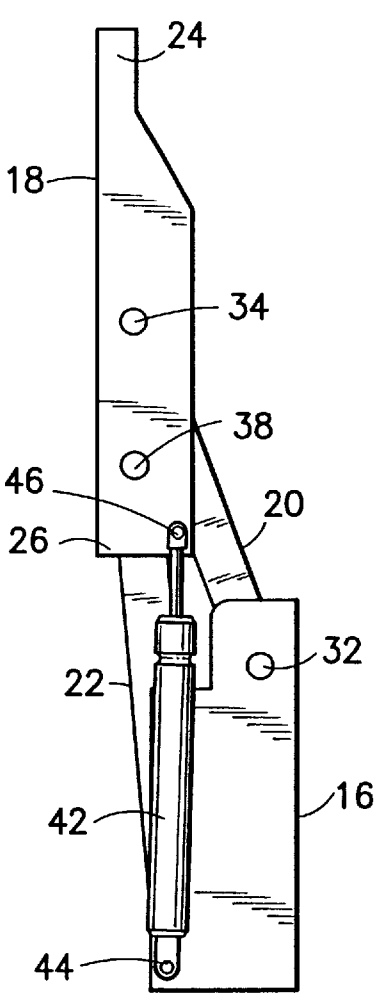
FIGS. 6 and 7 are elevation views from opposite sides of the hinge assembly of FIG. 4, but with the seat mounting bracket in the up, i.e., vertical, position.
Figure 6:
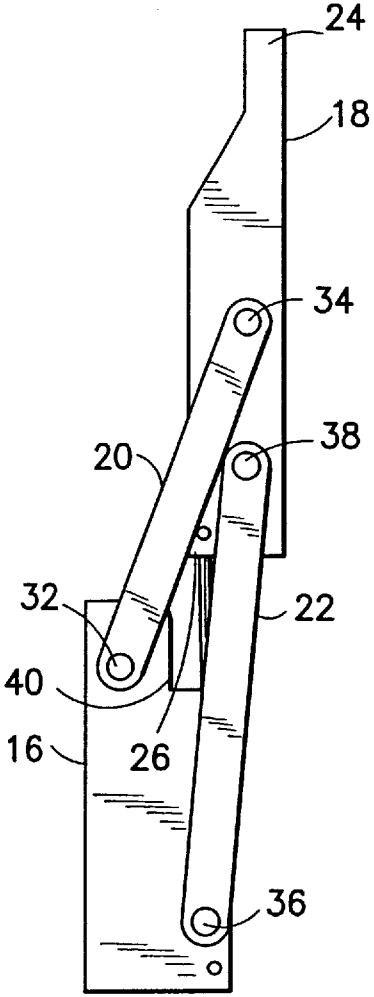
Figure 8:
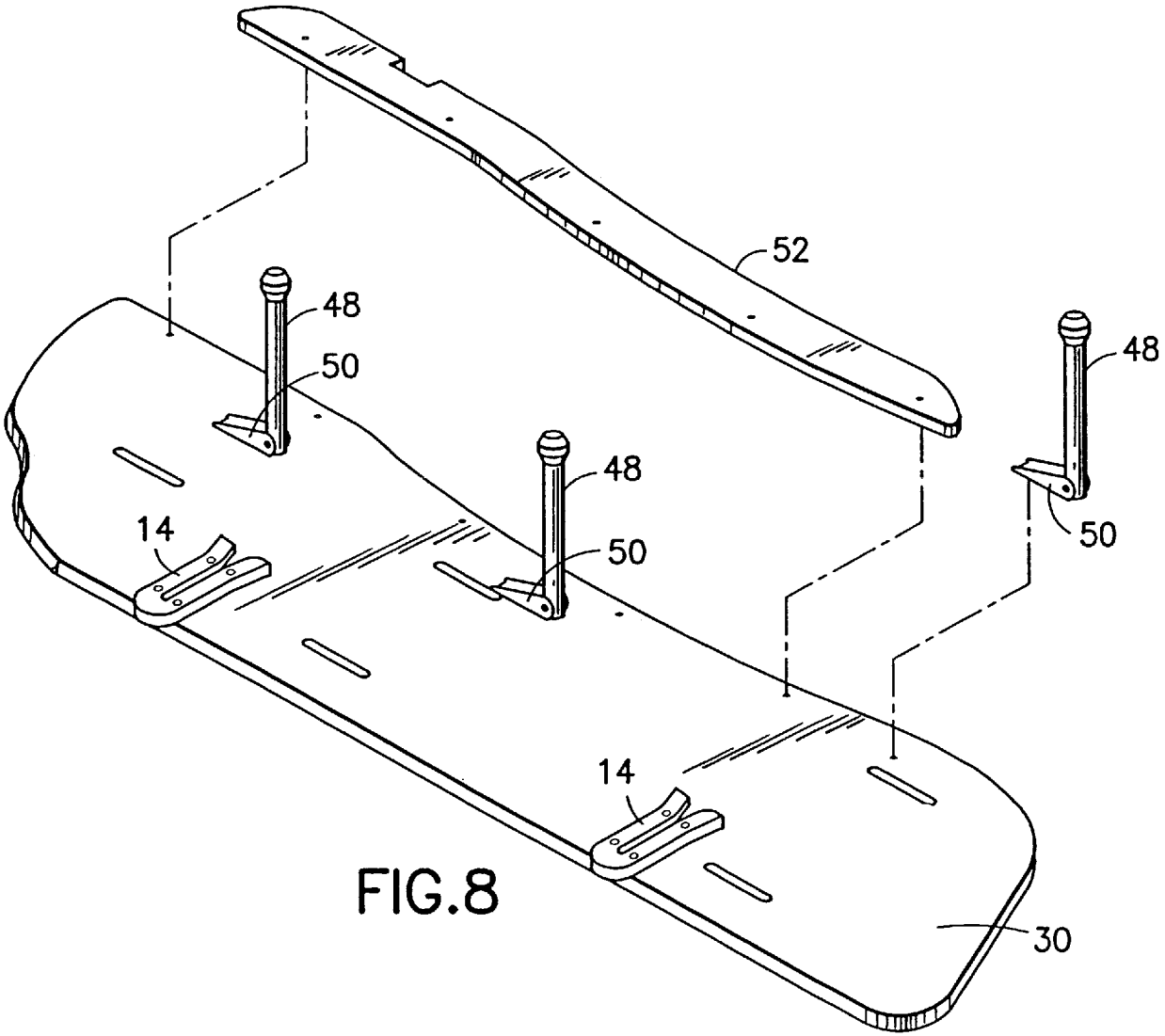
FIG. 8 is a partially exploded view of the lower surface of the seat subassembly.

FIGS. 4 and 5 show the hinge assembly with the seat mounting bracket 18 in a generally horizontal position, while FIGS. 6 and 7 show the hinge assembly with the seat mounting bracket 18 in a generally vertical position. It can be seen that the wall mounting brackets 16 have upper and lower regions. The seat mounting brackets are rigid, generally elongate structures having a longitudinal axis which extends in a direction generally perpendicular to the rear edge of a stiff planar backing 30 of the seat 6. As shown in FIGS. 6 and 7, each seat mounting bracket 18 has a rearward end 24 and an opposite forward end 26. The forward end is defined herein as that end which extends away from the wall 8 when the seat is in a horizontal position.

The upper pivoting arm 20 is pivotally connected at one end to the upper region of the wall mounting bracket 16 and at the other end to the middle of the seat mounting bracket 18. The lower pivoting arm 22 is pivotally connected at one end to the lower region of the wall mounting bracket 16 and at the other end to the forward end 26 of the seat mounting bracket 18. The upper pivoting arm 20 connects to the wall mounting bracket 16 at a first pivot 32 and to the seat mounting bracket 18 at a second pivot 34. The lower pivoting arm 22 connects to the wall mounting bracket 16 at a third pivot 36 and to the seat mounting bracket 18 at a fourth pivot 38. Preferably the pivots take the form of pop rivets.

As illustrated in FIGS. 4 and 6, the four pivots 32, 34, 36 and 38 are located to provide the above-described movement of the hinge mechanism. It can be seen that the first pivot 32 and the third pivot 36, both of which are on the wall mounting bracket 16, are offset both horizontally and vertically relative to each other. Particularly, the third pivot 36 is situated below and forward of the first pivot 32. The second pivot 34 and fourth pivot 38 are spaced apart on the seat mounting bracket 18, and together are parallel to a longitudinal axis of the seat mounting bracket 18, with the fourth pivot 38 being disposed forward of the second pivot 34.

When the seat is horizontal, as shown in FIG. 4, the seat mounting bracket 18 is horizontal also. In this orientation, the four pivots define a triangle with the first pivot 32, second pivot 34 and fourth pivot 38 aligned horizontally to form the base, or longest side, of the triangle, and the third pivot 36 forming the vertex opposing that base. As the arms 20 and 22 are rotated in a counterclockwise direction (as seen from the vantage of FIG. 4), the second pivot 34 describes an arc upward and rearward about the first pivot 32, while the fourth pivot 38 describes an arc upward and rearward about the third pivot 36. As this occurs, the fourth pivot 38 pivots relative to the second pivot 34, but in the clockwise direction when viewed as seen in FIG. 4. Since the seat is mounted to the seat mounting bracket 18, clockwise pivoting of the latter implies clockwise pivoting of the former.

During pivoting of the seat from a generally horizontal position (as shown in FIG. 4) to a generally vertical position (as shown in FIG. 6), i.e., a change of about 90°, the upper and lower pivoting arms 20 and 22 each pivot through an angle of less than 90°. The upper pivoting arm 20 pivots from a horizontal position to a position which is less than vertical, while the lower pivoting arm 22 pivots to a nearly vertical position from a position which is about 35° relative to the horizontal.

To prevent further rotation beyond the horizontal position, the rearward end 24 of the seat mounting bracket 18 has a flat edge which is adapted to abut a flat upper surface 25 of the wall mounting bracket 16 when the seat mounting bracket 18 is horizontal (as best seen in FIG. 5), thereby preventing further rotation and maintaining the seat 6 horizontal. The flat upper surface 25 is formed by a notch 40 in the wall mounting bracket 16 (see FIG. 6).

To stabilize the seat in a vertical position, the preferred embodiment of the seat assembly also comprises a pneumatic or hydraulic strut 42 (e.g., a standard gas shock absorber) having opposing ends pivotally mounted to the wall and seat mounting brackets, e.g., by means of respective ball studs 44 and 46. Preferably, the seat 6 also comprises one or more stanchions 48 affixed to the stiff backing 30 of the seat and being extended vertically to support weight placed on the seat. Preferably, the support stanchions or legs 48 are affixed to the stiff backing 30 of the seat by means of hinges 50 which allow the stanchions to be folded against the lower surface of the seat prior to folding of the seat to the upright position. Naturally, there should be sufficient clearance between the seat backing 30 and the opposing wall surface of transom 8 so that the folded stanchions do not strike the wall when the seat is folded upright. In addition, the seat can be reinforced by securing a rigid reinforcing member 52 to the front periphery of the seat backing 30.

It will be understood that the hinge assembly described above is not limited to use in conjunction with folding boat seats. For example, the hinge assembly can be suitably employed with any folding seat assembly where floor space is at a premium, for example, trains, planes, mobile homes, and recreational vehicles. The inventive mechanism could also be used for other horizontal surfaces, for example, folding tables and folding beds.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A folding assembly comprising a seat and a first hinge assembly for pivotally supporting said seat relative to said support surface, wherein said first hinge assembly comprises:

a first bracket mounted to said support surface;

a second bracket coupled to said seat;

a first arm having one end pivotally coupled to said first bracket at a first pivot point and another end pivotally coupled to said second bracket at a second pivot point;

a second arm having one end pivotally coupled to said first bracket at a third pivot point and another end pivotally coupled to said second bracket at a fourth pivot point, wherein said first through fourth pivot points are arranged such that said seat pivots in a clockwise direction when said first and second arms pivot in a counterclockwise direction;

a first mating member attached to said second bracket and a second mating member attached to a bottom surface of said seat, said second mating member being mated with said first mating member by sliding said second mating member relative to said first mating member in a plane parallel to said bottom surface of said seat; and wherein one of said first and second mating members has a pair of parallel projections and the other of said first and second mating members has a pair of parallel grooves which respectively form fit with and receive said projections.

2. The folding assembly as recited in claim 1, wherein said other of said first and second mating members having said pair of parallel grooves is closed at one end to stop further sliding of said one of said first and second mating members relative to said other of said first and second mating members.

3. The folding assembly as recited in claim 1, wherein said first and second mating members are made of plastic, and said first and second brackets and said first and second arms are made of metal.

* * * * *

UNITED STATES PATENT AND TRADEMARK OFFICE

CERTIFICATE OF CORRECTION

PATENT NO. : 6,527,341 B1
DATED : March 4, 2003
INVENTOR(S) : Martin

It is certified that error appears in the above-identified patent and that said Letters Patent is hereby corrected as shown below:

Title page,
Item [56], References Cited, U.S. PATENT DOCUMENTS: "5,974,397 11/1997 Dawson et al." should read -- 5,984,397 11/1999 Dawson et al. --

Signed and Sealed this

Sixteenth Day of September, 2003

JAMES E. ROGAN
*Director of the United States Patent and Trademark Office*